US006736522B1

(12) United States Patent
Cini

(10) Patent No.: US 6,736,522 B1
(45) Date of Patent: May 18, 2004

(54) ADJUSTABLE-LENGTH LIGHT FIXTURE AND METHOD FOR INSTALLING SAME

(75) Inventor: Samuel Cini, Brampton (CA)

(73) Assignee: Signage Systems, Mississauga (CA)

( * ) Notice: Subject to any disclaimer, the term of this patent is extended or adjusted under 35 U.S.C. 154(b) by 0 days.

(21) Appl. No.: 10/300,489

(22) Filed: Nov. 20, 2002

(51) Int. Cl.[7] ..... F21S 8/00

(52) U.S. Cl. ..... 362/145; 362/147; 362/150; 362/151; 362/152; 362/219; 362/220; 362/217

(58) Field of Search ..... 362/145, 147, 362/150, 151, 152, 219, 220, 224, 225, 217, 418, 419

(56) References Cited

U.S. PATENT DOCUMENTS

| | | | |
|---|---|---|---|
| 2,408,783 | A | 10/1946 | Kloner |
| 4,385,346 | A | 5/1983 | Spicer |
| 4,455,594 | A | 6/1984 | Yang |
| 4,748,548 | A | 5/1988 | Barton |
| 5,221,139 | A | 6/1993 | Belfer |
| 5,381,324 | A | 1/1995 | Hillstrom et al. |
| 5,404,279 | A | 4/1995 | Wood |
| 5,550,725 | A | 8/1996 | Shemitz et al. |
| 5,819,418 | A | 10/1998 | Uhl |
| 6,007,217 | A | 12/1999 | Ferrier |

*Primary Examiner*—Thomas M. Sember
*Assistant Examiner*—Mark Tsidulko
(74) *Attorney, Agent, or Firm*—Pearne & Gordon LLP

(57) ABSTRACT

An elongate light fixture, the light fixture having an adjustable overall length, and a method of installing same. The elongate light fixture includes a first piece that includes a first reflector shroud portion and a second piece that includes a second reflector shroud portion. The first and second pieces are coupled to a frame to permit relative movement of the first and second pieces for spacing the first and second pieces at a desired distance apart to provide the desired overall length of the housing arrangement and to provide a space between the first and second pieces. The adjustable-length, elongate light fixture further includes an insert that is trimmable to fit in the space between the first and second pieces. The method of installing an adjustable-length, elongate light fixture, the method including moving a first piece, which includes a first reflector shroud, of a housing arrangement relative to a second piece, which includes a second reflector shroud, of the housing arrangement. The step of moving includes moving the first and second pieces relative to each other and spacing the first and second pieces at a desired distance apart to provide the desired overall length of the housing arrangement. The method further includes trimming an insert to fit in the space between the first and second pieces, and securing the trimmed insert into the space.

17 Claims, 4 Drawing Sheets

ADJUSTABLE-LENGTH LIGHT FIXTURE AND METHOD FOR INSTALLING SAME

FIELD OF THE INVENTION

The present invention is directed in general to light fixtures, and more particularly to adjustable light fixtures that are capable of being expeditiously sized on-site to fit the area of installation, and a method of installing same.

BACKGROUND OF THE INVENTION

Linear light fixtures are installed in a sequence to extend along a length of an area, such as a room or work station. Typically, the linear light fixtures are sequentially installed beginning from a predetermined starting point. By commencing installation of linear light fixtures at a convenient starting point, several linear light fixtures may be mounted to span at least a majority of the area receiving the lights. However, because the overall length or width of the area receiving the lights is rarely an integer multiple of a single linear light fixture, there is typically a remainder length of the room where a standard-length linear light fixture is not installed. Shadows and dark areas may exist beneath the remainder lengths where uniform illumination is not adequately provided by the standard-length linear light fixtures.

Various light fixtures have been developed in an attempt to create a fixture that can provide uniform illumination in areas such as offices or rooms, for example, of a wide range of sizes. Generally, banks of fluorescent lamps periodically placed along the ceiling have been used for such a purpose. To provide maximum illumination, several lamps were often flush mounted end-to-end in axial alignment. Thus, the lamp sockets that engaged the ends of the fluorescent lamps were often in physical contact with another socket, thereby minimizing the distance between them. However, dark areas or shadows still existed in regions beneath the lamp sockets and beneath areas of the ceiling where a fluorescent lamp was not situated.

In one technology, flourescent lamps were arranged so that an end of one fluorescent lamp overlapped, or extended beyond, an end of another fluorescent lamp. Overlapping the lamps prevented dark areas caused by spaces between the lamps required for objects such as lamp sockets, for example. However, since light fixtures are rigid structures with a length that can not be adjusted to match the dimensions of a particular room, installation of such lamps usually left portions of the room poorly lit. Thus, dark or shadow areas still existed beneath the remaining, unlighted portions of the ceiling, making it difficult to view objects in those areas. Furthermore, the location of furnishings such as a desk in an office, or a reading chair in a sitting room, for example, had to be chosen to avoid such dark areas if alternative lighting options were not available.

Alternative lighting fixtures have been developed to allow the custom installation of fluorescent lamps to more completely illuminate a room. Slidably extending light fixtures can be extended to accommodate fluorescent lamps of different lengths. The extending member is simply extended to an appropriate length to accommodate a fluorescent lamp. However, the overall length of such light fixtures is still constrained by the length of common fluorescent lamps.

Yet another technology developed to provide uniform illumination of a room includes an elongated track that can accept a plurality of individual lights. The lights can be adjusted to a position where enhanced illumination is required along the length of the track. However, the drawback of this technology is that the length of the track is not adjustable. Thus, the overall length of this type of light fixture is no more adaptable to the dimensions of a room than the axial alignment of fluorescent lamps discussed above.

Methods of installing lamps have also been developed to eliminate non-uniform illumination of a room. An example of such a method is the custom fabrication and installation of lighting fixtures according to the particular dimensions of a room on a case-by-case basis. According to this method, the exact dimensions of the area of installation must be measured, typically by a professional installation technician. The measurements must be exact, and must be accurately transmitted to a manufacturing facility where the fixtures are assembled according to the measurements. Custom installation of light fixtures is time consuming considering that the light fixtures can not be fit and assembled on site.

Furthermore, the method of custom installing light fixtures includes several opportunities for the introduction of errors into the method, errors that would lead to large amounts of waste. An erroneously manufactured light fixture must be replaced by a replacement light fixture that must also be fabricated. The erroneously manufactured light fixture is then discarded unless another area of installation requires a light fixture with those same dimensions, which is highly unlikely. And finally, the cost of materials and labor for custom installation of light fixtures often exceeds the benefits derived therefrom.

It would be beneficial to provide a low-cost apparatus and method for producing uniform illumination of a room using standard length fluorescent lamps. The apparatus should be rapidly adjustable to accommodate the specific dimensions of the room at the area of installation without a significant amount of labor or waste.

SUMMARY OF THE INVENTION

In accordance with one aspect, the present invention provides an elongate light fixture having an adjustable overall length to fit within the remainder portion of the area receiving lights. The elongate light fixture includes a first piece that includes a first reflector shroud portion and a second piece that includes a second reflector shroud portion. The first and second pieces are coupled to a frame to permit relative movement of the first and second pieces for spacing the first and second pieces at a desired distance apart to provide the desired overall length of the housing arrangement and to provide a space between the first and second pieces. The adjustable-length, elongate light fixture further includes an insert that is trimmable to fit in the space between the first and second pieces.

In accordance with another aspect, the present invention also provides a method of installing an adjustable-length, elongate light fixture, the method including moving a first piece, which includes a first reflector shroud, of a housing arrangement relative to a second piece, which includes a second reflector shroud, of the housing arrangement. The step of moving includes moving the first and second pieces relative to each other and spacing the first and second pieces at a desired distance apart to provide the desired overall length of the housing arrangement. The method further includes trimming an insert to fit in the space between the first and second pieces, and securing the trimmed insert into the space. dr

BRIEF DESCRIPTION OF THE DRAWINGS

The foregoing and other features and advantages of the present invention will become apparent to those skilled in the art to which the present invention relates upon reading the following description with reference to the accompanying drawing, in which.

DETAILED DESCRIPTION OF AN EXAMPLE EMBODIMENT

Figure 1:
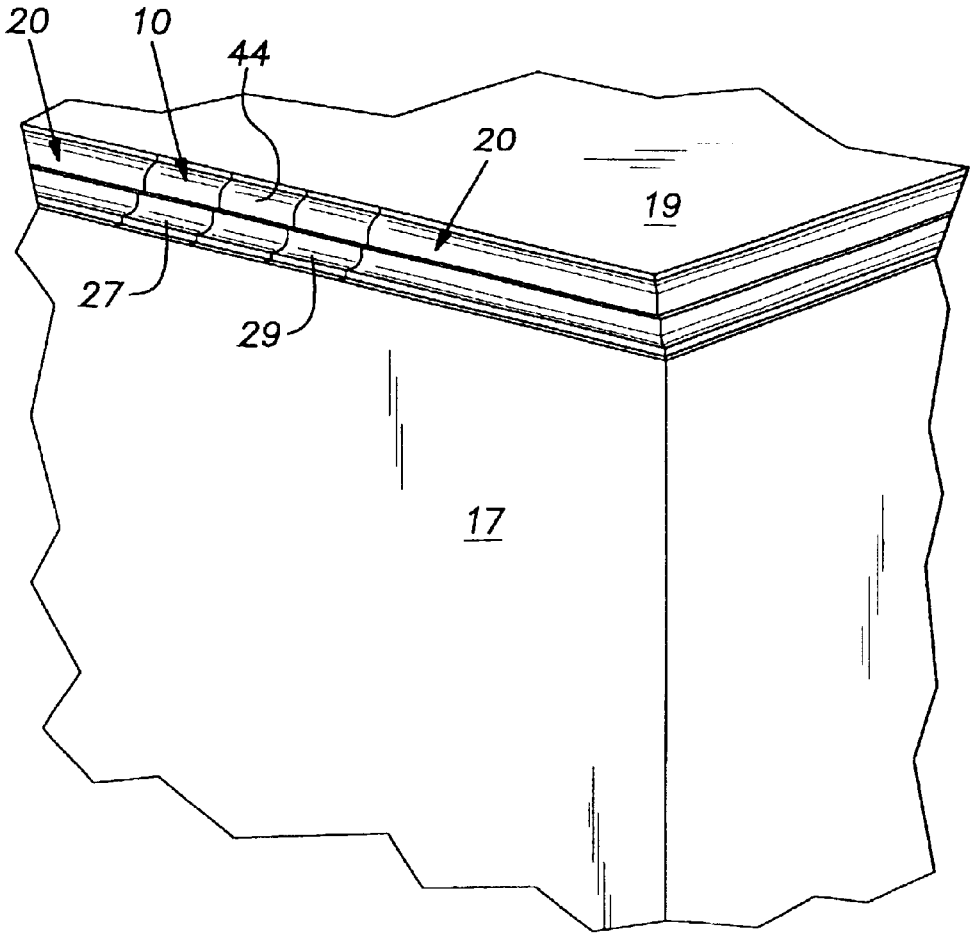
FIG. 1 is an illustrative view of an example of a light fixture in accordance with the present invention installed in a room, wherein the light fixture has been adjusted and installed according to the dimensions of the room, thereby providing uniform illumination.

Certain terminology is used herein for convenience only and is not to be taken as a limitation on the present invention. Further, in the drawings, the same reference numerals are employed for designating the same elements throughout the six figures, and in order to clearly and concisely illustrate the present invention, certain features may be shown in somewhat schematic form.

An example of an adjustable-length light fixture 10 installed for providing uniform illumination to a room is shown in FIG. 1. The adjustable-length light fixture 10 is installed at an upper portion of a wall 17 adjacent the ceiling 19. Conventional fasteners (not shown) communicate with apertures 21 in a rear member 22 that encloses the light fixture 10 on a rear side that is located adjacent to the wall 17 when the light fixture 10 is installed. This communication between the fasteners and the aperture supports the light fixture 10 in position at the top of the wall 17. Although the installation of the light fixture 10 is described above with reference to its installation at the top of the wall 17, it is to be appreciated that the light fixture 10 is adaptable for installation at any area where uniform illumination is desired.

Figure 2:
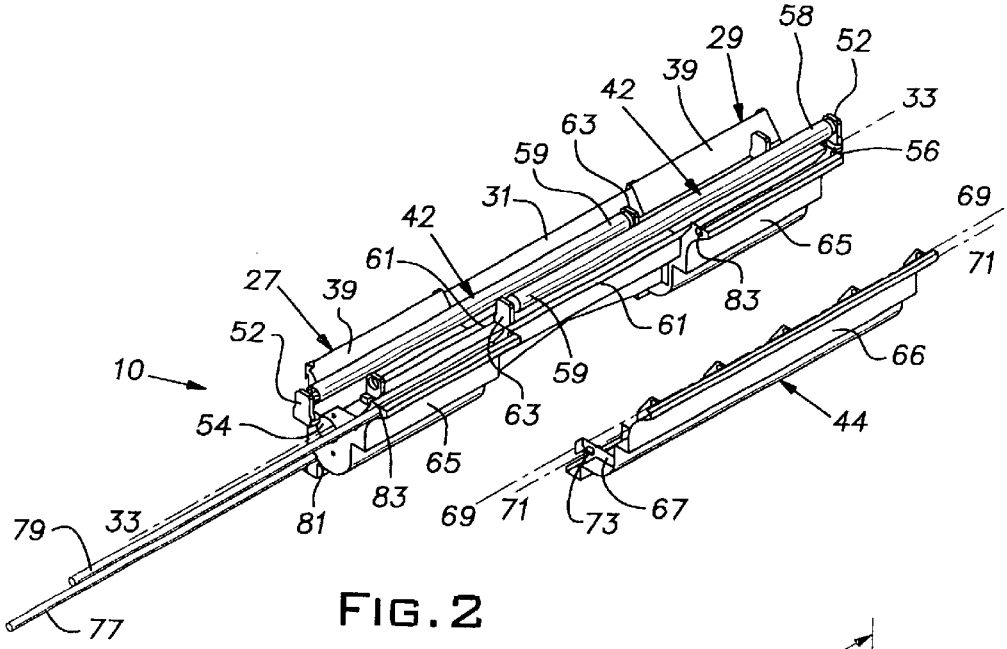
FIG. 2 is a schematic representation of a light fixture and insert in accordance with the present invention, the light fixture being unextended prior to installation.
Figure 6:
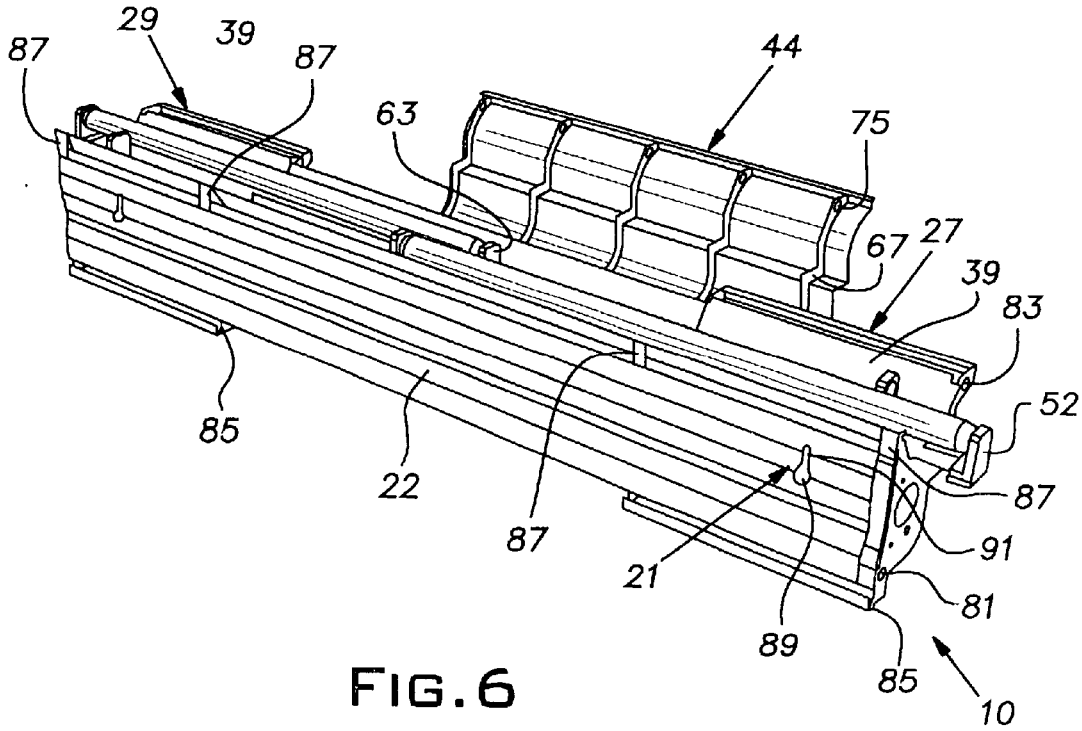
FIG. 6 is another schematic representation of a light fixture and shows a rear member.

The area of installation often has a length greater than the length of a fixed-length linear light fixture 20, but less than the length required for installing two flush mounted fixed-length linear light fixtures 20 in axial alignment. The light fixture 10 having an adjustable overall length L according to the present invention allows for custom installation of the light fixture 10 in such an unconventional area of installation. In an undeployed mode as shown in FIG. 2, a housing arrangement 25 is sufficiently sized to fit in the area of installation. After extending the overall length L of the housing arrangement to a deployed mode (FIG. 3) equal in length to the dimensions of the area of installation, the rear member 22 (see FIG. 6) and an insert 44 (FIG. 3) are trimmed for proper installation onto the housing arrangement 25. Once the rear member 22 and insert 44 are sized for installation, they are installed onto the housing arrangement 25, and together form a portion of the light fixture 10 according to the present invention.

The housing arrangement 25 includes a first piece 27 and a second piece 29 that are adjustably coupled to a frame member 31 such that the first and second pieces 27, 29 laterally oppose each other along a common elongate axis 33 of translational movement. Disposed at an upper portion of each of the first and second pieces 27, 29 is a generally concave reflector shroud 39. Light energy produced by a respective linear lamp 42 in the light fixture 10 is reflected away from the light fixture 10 by the respective reflector shroud 39 to enhance the illumination of areas adjacent to the area of installation.

A first sleeve 48 formed in the first piece 27 and a second sleeve 49 formed in the second piece 29 are disposed below each respective reflective shroud 39. The first sleeve 48 receives a portion of a proximate end of the frame member 31 and the second sleeve 49 receives a portion of a distal end of the frame member 31. Relative movement between the frame member 31 and each of the first and second sleeves 48, 49 provide telescopic communication for changing from the undeployed mode to the deployed mode. The distance that the first and second pieces 27, 29 can travel with respect to the frame member 31 is limited to the length of the proximate and distal ends of the frame member 31 received within the sleeves 48, 49 in the undeployed mode. When the length L of the housing arrangement 25 is extended from the undeployed mode to the deployed mode, the first piece 27 and the second piece 29 are separated along the axis 33 by exposing a portion of the frame member 31 from within the first and second sleeves 48, 49. Thus, in the undeployed mode, a significant portion of the proximate and distal ends of the frame member 31 are concealed within the first and second sleeves 48, 49, respectively. In the deployed mode, a portion of the once concealed proximate and distal ends of the frame member 31 are exposed between the separated first and second pieces 27, 29.

According to an alternative embodiment of the present invention, the proximate end of the frame member 31 is fixed at a distance within the first sleeve 48 and only the second piece 29 is adjustably coupled to the frame member 31. In the undeployed mode, the second piece 29 is located adjacent to the first piece 27 and a significant portion of the distal end of the frame member 31 is received within the second sleeve 49. In the deployed mode, the second piece 29 is separated from the first piece 27, leaving a once concealed portion of the frame member 31 exposed between the first and second pieces 27, 29.

Figure 3:
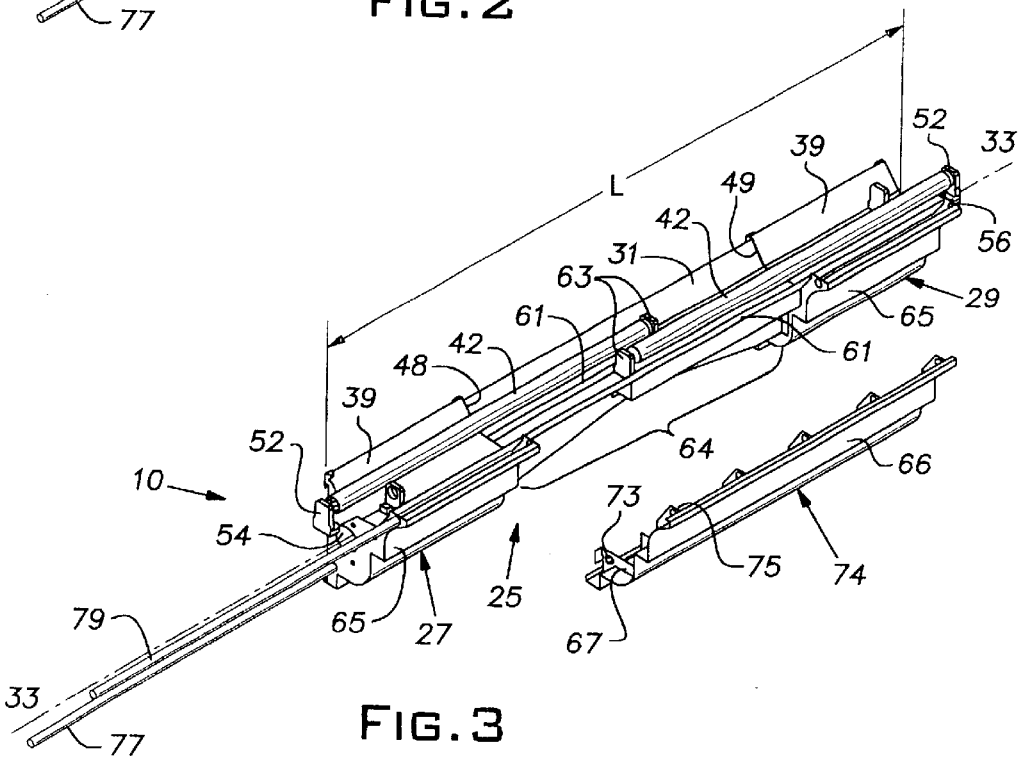
FIG. 3 is a schematic representation of a light fixture and insert in accordance with the present invention, the light fixture being extended to a length that matches the length of an area of installation.
Figure 4:
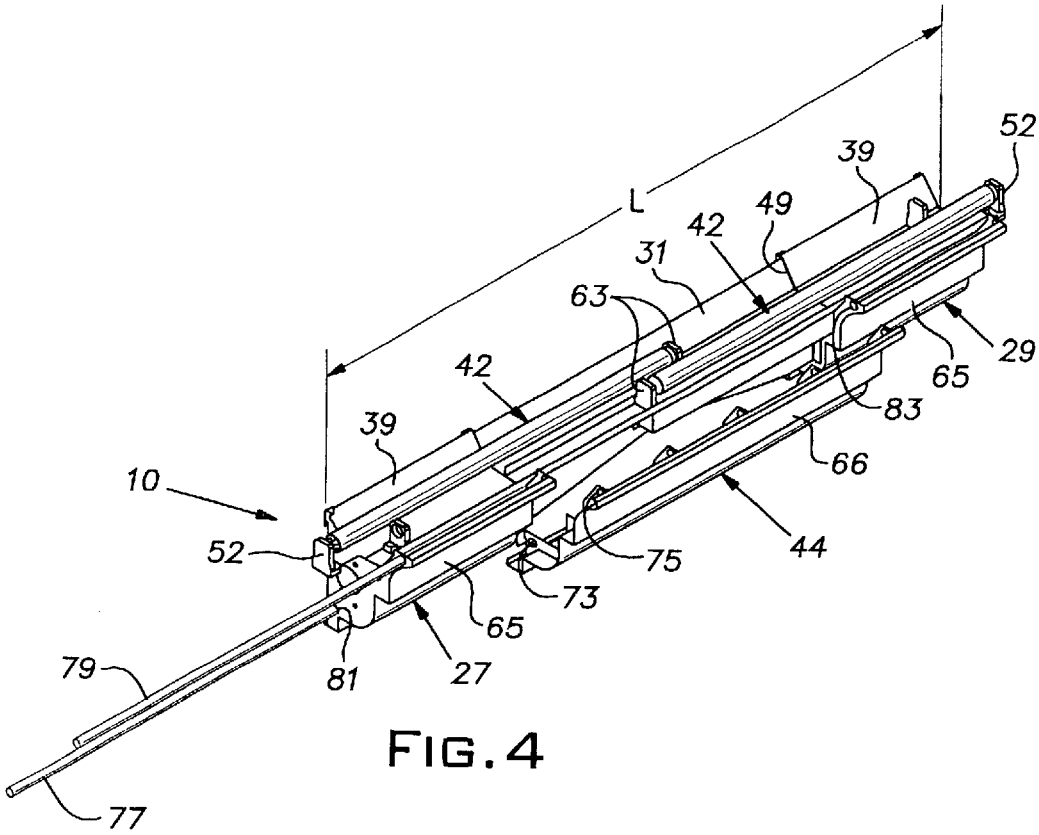
FIG. 4 is a schematic representation of a light fixture and an insert in accordance with the present invention, the insert having been trimmed to be compatible with the extended light fixture.
Figure 5:
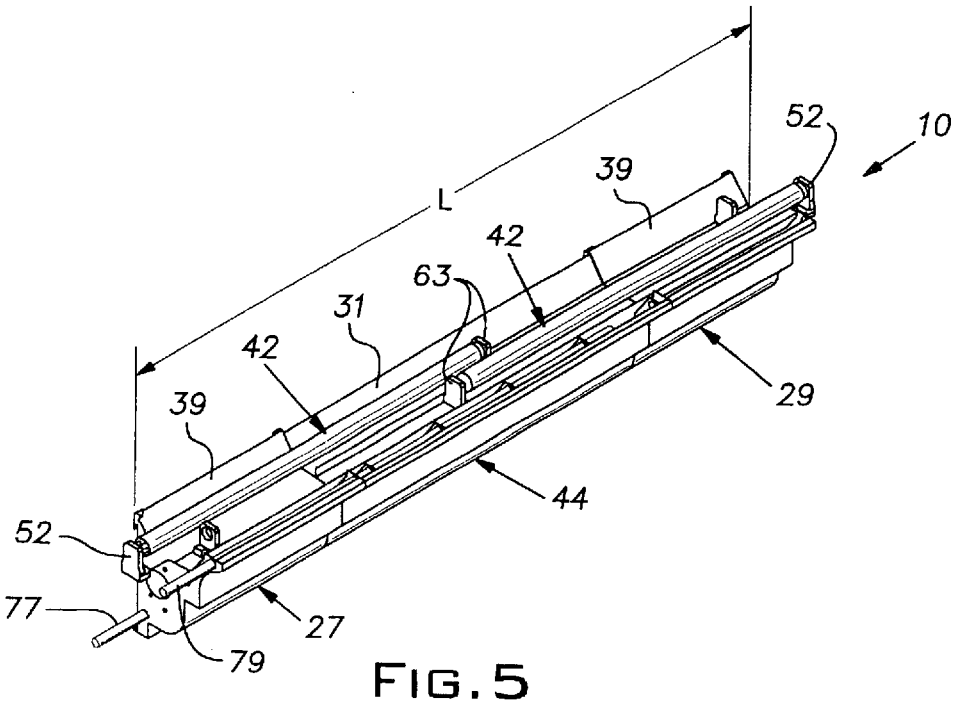
FIG. 5 is a schematic representation of a light fixture having a trimmed insert fastened to the light fixture in accordance with the present invention.

The frame member 31 is generally concave shaped and shares light energy reflecting properties similar to those of the reflector shroud 39. When the housing arrangement is in the deployed mode, as shown in FIGS. 3–5, a portion of the frame member 31 is exposed between the first piece 27 and the second piece 29. This exposed portion of the frame member 31 serves to reflect light energy from the linear lamps 42 away from the light fixture 10 in the area between the reflector shroud 39 of the first and second pieces 27, 29.

A peripheral electrical socket 52 for receiving a first end 58 of the linear lamp 42, such as a fluorescent lamp tube, for example, is included at the outer edge 54 of the first piece 27, and another peripheral electrical socket 52 for receiving a first end of another linear lamp 42 is included at the outer edge 56 of the second piece 29. The peripheral electrical sockets 52 are located beyond the outer edges 54, 56 to permit a horizontal, or side-by-side, overlap with linear lamps (not shown) similarly located beyond adjacent fixed-length linear light fixtures 20 (FIG. 1). Through this arrangement, uniform illumination is achieved even at the boundaries between the adjustable-length light fixture 10 according to the present invention and adjacent fixed-length linear light fixtures 20.

The adjustable-length light fixture 10 according to the present invention further includes a projection 61 extending from the first piece 27 towards the second piece 29 and another projection 61 extending from the second piece 29 toward the first piece 27. Each projection 61 includes an electrical socket 63 for receiving a second end 59 of the linear lamps 42. Such an arrangement of sockets 52, 63 is used to energize lamps 42 that require a socket 52,63 to receive a terminal at both ends of the linear lamps 42 for operation.

The sockets 52,63 are positioned to receive the linear lamps 42 in a position that is generally parallel to the axis 33 so that the second ends 59 of the linear lamps 42 project generally toward the peripheral electrical socket 52 located at the outer edge of the opposing piece. Accordingly, the peripheral electrical socket 52 at the outer edge 54 of the first piece 27 and the socket 63 of the projection 61 extending from the first piece 27 receive the linear lamp 42 so that the second end 59 of the linear lamp 42 projects generally toward the peripheral electrical socket 52 located at the outer edge 56 of the second piece 29. Similarly, the peripheral electrical socket 52 at the outer edge 56 of the second piece 29 and the socket 63 of the projection 61 extending from the second piece 29 receive the linear lamp 42 so that the second end 59 of the linear lamp 42 projects generally toward the peripheral electrical socket 52 located at the outer edge 54 of the first piece 27. The sockets 52,63 are laterally offset with respect to each other so that a second end 59 of the lamp 42 supported by the sockets 52,63 of the first piece extends beyond the second end 59 of the lamp 42 supported by the sockets 52,63 of the second piece. Thus, a horizontal, or side-by-side, overlap of a portion of the distal ends 59 of the lamps 42 is achieved.

The dimensions of the housing arrangement 25 allow for a significant horizontal overlap of lamps 42 in the undeployed mode illustrated in FIG. 2. In the deployed mode (FIGS. 3–5), the degree of the horizontal overlap of the lamps 42 is reduced by the length the first piece 27 is separated from the second piece 29 axially along the axis 33. When the first piece 27 and the second piece 29 are separated by the greatest distance permitted by the length of the frame member 31, a horizontal overlap of the lamps 42 remains, although to a lesser extent than the overlap present when the housing arrangement 25 is in the undeployed mode. Despite the length L of the housing arrangement 25 selected for installation, however, a degree of horizontal overlap of the distal ends 59 of the lamps 42 exists.

An alternative embodiment of the present invention includes first and second pieces 27, 29 adapted to energize lamps (not shown) that require only a single socket (not shown) for operation. Such an alternative embodiment would include the socket located beyond the outer edge 54 of the first piece 27 and another socket located beyond the outer edge 56 of the second piece 29. The lamps extend towards the opposing socket in an arrangement providing a horizontal, or side-by-side, overlap of distal ends of the lamps similar to that described above.

When the housing arrangement 25 is extended to the desired length for installation at the area of installation, a void 64 is left between the first and second pieces 27, 29. The insert 44 includes a face portion 66 having an appearance similar to that of the face portions 65 of the first and second pieces 27, 29. After the insert is installed to replace the void 64 the light fixture 10 has a finished outer appearance.

To conceal the void 64, the length of the insert is 44 trimmed to match the dimensions of the void 64. Supporting ribs 67 located on an inner face of the insert 44 are spaced so that a plurality of ribs 67 remain on the insert 44 despite the length to which the insert 44 is trimmed. Each rib 67 includes at least a lower aperture 73 located at a lower portion of the rib 67 and an upper aperture 75 located at an upper portion of the rib 67. The lower aperture 73 of each rib 67 is generally coaxial with the other lower aperture 73, all sharing a common central axis 71. Likewise, the upper aperture 75 of each rib 67 is generally coaxial with the other upper aperture 75, all sharing a common central axis 69.

At least a first rod 77 and a second rod 79 secure the insert 44 to the housing arrangement 25, thus filling the void 64 formed when the housing arrangement 25 is in the deployed mode. When the insert 44 is properly aligned with the housing arrangement 25, the lower aperture 73 are coaxial with a lower passage 81 formed in both the first and second pieces 27, 29 for supporting the first rod 77 on opposite sides of the insert 44. Thus, once the insert 44 is in alignment, the lower passages 81 and the lower aperture 73 share the common central axis 71. The lower passage 81 could be any structure capable of receiving and holding the first rod 77 to support the insert 44 such as an aperture, a channel, a tube, or a ring structure, for example, having an inner diameter greater than the outer diameter of the first rod 77.

Similarly, when the insert 44 is properly aligned with the housing arrangement 25, the upper aperture 75 are coaxial with an upper passage 83 formed in both the first and second pieces 27, 29 for supporting the second rod 79 on opposite sides of the insert 44. Thus, once the insert 44 is in alignment, the upper passages 83 and the upper aperture 75 share the common central axis 69. The upper passage 83 could be any structure capable of receiving and holding the first rod 77 to support the insert 44 such as an aperture, a channel, a tube, or a ring structure, for example, having an inner diameter greater than the outer diameter of the second rod 79.

If necessary to prevent the rods 77, 79 from protruding beyond the outer edges 54, 56, the first and second rods 77, 79 are trimmed to an appropriate length (e.g., prior to installation). Each rod should have a length that allows insertion of the rods 77, 79 into the upper and lower passages 81, 83 at one of the outer edges 54, 56. Once the rods 77, 79 are fully inserted, they extend from the first piece 27, through the support ribs 67 of the insert 44, and into the second piece 29. The communication between the rods 77, 79, the first and second pieces 27, 29, and the insert 44 create a finished outer appearance for the adjustable-length light fixture 10 according to the present invention.

An alternative embodiment of the present invention includes a light fixture 10 having the insert 44 coupled to the housing arrangement 25 using only the first rod 77. According this alternative embodiment, a fastening feature (not shown) located adjacent to either the lower portion or the upper portion of the ribs 67 engages a compatible member (not shown) of the housing arrangement 25. The communication between the compatible member and the fastening feature supports the portion of the insert adjacent to the fastening feature. A remaining portion of the insert 44 without the fastening feature is then placed in alignment, just as before, within the void 64 so that apertures disposed at the remaining portion of the ribs 67 are generally concentric with a corresponding passage in the first and second pieces 27, 29. The first rod 77 having a suitable length installed as above extends through the apertures in the ribs 67 and into the corresponding passages in the first and second pieces 27, 29, thus holding the insert in place.

To complete the adjustable-length light fixture 10, the rear member 22 (FIG. 6) is fastened to the housing arrangement 25 to allow the rear member 22 to be slid into a desired position. Supporting the lower portion of the rear member 22 is a generally J-shaped channel 85 formed at a lower portion of the first and second pieces 27, 29. Rear fasteners 87 extend rearwardly from the upper portion of the first and second pieces 27, 29 and hang over an upper portion of the rear member 22. The rear member 22 rests in the channel 85 and is held adjacent to the housing arrangement 25 by the rear fasteners 87.

A method of providing uniform illumination throughout a desired area using the light fixture 10 of the present invention includes installing fixed-length linear light fixtures 20 and installing the adjustable-length light fixture 10. The method of the present invention minimizes dark areas and shadows beneath the light fixtures 10, 20, and will be described in detail below with reference to the installation of light fixtures adjacent to the upper portion of the wall 17 of the room, as shown in FIG. 1.

Typical installation of the fixed-length linear light fixtures 20 begins at two starting points, the starting points being located at opposite ends of the wall. The fixed-length linear light fixtures 20 are flush-mounted in axial alignment in an end-to-end configuration. Installation of the fixed-length linear light fixtures 20 progresses from each starting towards the opposing starting point at the opposite end of the wall. When the two series of fixed-length linear light fixtures 20 installed from each starting point are separated by a distance that is within the range of lengths of the adjustable-length light fixture 10, installation of the fixed-length linear light fixtures 20 is complete. This distance between the fixed-length linear light fixtures 20 is the area of installation for the adjustable-length light fixture 10 of the present invention.

Installation of the adjustable-length light fixture 10 includes a fitting step, an adjusting step, and a finishing step. As part of the fitting step, the length of the area of installation is determined. This is the length L that the housing arrangement must be extended to for proper installation. Obtaining the appropriate length L can be accomplished in a variety of ways including measuring the area of installation with a calibrated measuring instrument, for example, or by actually placing the housing arrangement 25 in the area of installation and extending it to the appropriate length L.

The adjusting step includes using the length L obtained above to adjust the length of the customizable components of the adjustable-length lighting fixture 10. The rear member 22 is trimmed to a length generally equal to the length L of the housing arrangement 25 in the deployed mode. If necessary, the first and second rods 77, 79 are trimmed as described above. And the length of the insert 44 is trimmed to a length that is generally equal to the length of the void 64 when the housing arrangement 25 is in the deployed mode.

After adjusting the length of the customizable components of adjustable-length light fixture 10, the adjustable-length light fixture 10 is assembled and installed in the area of installation as part of the finishing step. The finishing step includes fastening the rear member 22 to the rear portion of the housing arrangement 25, inserting the insert 44 into the void 64, holding the insert in place in the void 64 with the first and second rods 77, 79, and mounting the assembled adjustable-length light fixture 10 at the area of installation.

The lower portion of a first side of the rear member 22 is placed in the channel 85 at the outer edge 54 of the first piece 27. The rear member 22 is slid further along the length of the channel 85 of the first piece 27 until it reaches the rear fastener 87 of the first piece 27. When the upper portion of the rear member 22 reaches the rear fastener 87 of the first piece, the rear member 22 passes between the rear fastener 87 and the housing arrangement 25. When the first side of the rear member 22 reaches the second piece 29, it is similarly placed in the channel 85 and passes between the rear fastener 87 of the second piece 29 and the housing arrangement 25.

Further according to the finishing step, the trimmed insert 44 is placed within the void 64 such that the upper apertures 75 are generally concentric with the upper passage 83 of both the first piece 27 and the second piece 29. When the insert 44 is in place, the apertures 75 and the upper passages 83 share the common central axis 69. The second rod 79 is then inserted from the outer edge 54 into the upper passage 83 of the first piece 27, through the upper apertures 75, and into the upper passage of the second piece 29.

Similarly, the process is repeated for the insertion of the first rod 77 into the lower passages 81 and the lower apertures 73. The second rod 79 holding the upper portion of the insert 44 in the housing arrangement 25 acts as a hinge assembly that allows the lower portion of the insert 44 to rotate about the second rod 79. Thus, the lower apertures 73 are aligned with the lower passage 81 of the first and second pieces 27, 29 by rotating the insert 44 into place. Inserting the first rod 77 from the outer edge 54 into the passage of the first piece 27, through the insert 44, and into the passage of the second piece 29 secures the insert 44 to the housing arrangement 25 to conceal the void 64.

Mounting the light fixture 10 at the area of installation includes securing conventional fasteners (not shown) to the wall at the area of installation and providing communication between the conventional fasteners and the apertures 21 in the rear member 22. The apertures 21 in the rear member 22 are preferably keyhole shaped to accept a head (not shown) of the conventional fasteners through a first portion 89 of the apertures 21 and to prevent passage of the head of the conventional fasteners through a second portion 91 of the apertures 21. To provide the communication between the fasteners and the apertures 21, the light fixture 10 is elevated to permit the head of the fasteners to pass through the first portion 89 of the apertures 21 in the rear member 22. Once the head of the fasteners has passed through the first portion 89 of the apertures 21, the light fixture 10 is lowered, allowing the head of the fasteners to come to rest adjacent the second portion 91 of the apertures 21. Thus, the weight of the light fixture 10 prevents the head of the fasteners from passing through the first portion 89 of the apertures 21.

From the above description of the invention, those skilled in the art will perceive improvements, changes and modifications. Such improvements, changes and modifications within the skill of the art are intended to be covered by the appended claims.

What is claimed is:

1. An elongate light fixture having an adjustable overall length and including:

a first piece including a first reflector shroud portion;

a second piece including a second reflector shroud portion, the first and second pieces coupled to a frame to permit relative movement of the first and second pieces for spacing the first and second pieces at a desired distance apart to provide the desired overall length of the housing arrangement and to provide a space between the first and second pieces; and an insert that is trimmable to fit in the space between the first and second pieces.

2. The elongate light fixture as set forth in claim 1, including means for supporting the third piece relative to the first piece and the second piece.

3. The elongate light fixture according to claim 2, wherein the supporting means is a rod for inserting through the first and second pieces and the insert, the rod being supported by the first and second pieces on opposite sides of the insert.

4. The elongate housing arrangement according to claim 1, wherein the first and second pieces further include a sleeve in communication with the frame to permit telescopic relative movement of the first and second pieces.

5. The elongate housing arrangement according to claim 1 further including a rod for inserting through the first and second pieces and the insert, wherein the rod is supported by the first and second pieces on opposite sides of the insert.

6. The elongate housing arrangement according to claim 1 further including a first electrical connector arrangement on the first piece and a second electrical connector arrangement on the second piece.

7. The elongate light fixture according to claim 6, wherein the first electrical connector arrangement is adapted to receive a first linear bulb and the second electrical connector is adapted to receive a second linear bulb, the first and second linear bulbs horizontally overlapping each other despite the overall length of the light fixture.

8. An elongate light fixture having an adjustable overall length and including:

a first piece including a first reflector shroud portion;

a second piece including a second reflector shroud portion, the first and second pieces coupled to a frame to permit relative movement of the first and second pieces for spacing the first and second pieces at a desired distance apart to provide the desired overall length of the housing arrangement and to provide a space between the first and second pieces; and an insert adapted to be secured between the first and second pieces by a rod extending through the insert and into the first and second pieces on opposite sides of the insert.

9. The elongate light fixture according to claim 8, wherein the length of the insert is adaptable to fit in the space between the first and second pieces.

10. The elongate light fixture according to claim 8, wherein the first and second pieces further include a sleeve in communication with the frame to permit telescopic relative movement of the first and second pieces.

11. A method of installing an adjustable-length, elongate light fixture, the method including:

moving a first piece, which includes a first reflector shroud, of a housing arrangement relative to a second piece, which includes a second reflector shroud, of the housing arrangement, the step of moving includes moving the first and second pieces relative to each other and spacing the first and second pieces at a desired distance apart to provide the desired overall length of the housing arrangement;

trimming an insert to fit in the space between the first and second pieces; and securing the trimmed insert into the space.

12. The method of installing an adjustable-length, elongate light fixture according to claim 11 further including the step of trimming a rear member to secure to a rear portion of the housing arrangement.

13. The method of installing an adjustable-length, elongate light fixture according to claim 12, further including the step of securing the light fixture at a desired location by communication between a conventional fastener and an aperture in the rear member.

14. The method of installing an adjustable-length, elongate light fixture according to claim 11 further including the step of trimming a rod to a suitable length for securing the trimmed insert into the space, the rod extending through the insert and into the first and second pieces on opposite sides of the insert.

15. A method of providing generally uniform illumination using an adjustable-length, elongate light fixture, the method including:

installing a first fixed-length, elongate light fixture from a first starting point at a desired area of installation; and installing an adjustable-length, elongate light fixture in a remainder portion of the desired area of installation.

16. The method of providing generally uniform illumination according to claim 15 further comprising the step of installing a second fixed-length, elongate light fixture from a second starting point located away from the first starting point, the installation of the second fixed-length, elongate light fixture extending in the direction of the first fixed-length, elongate light fixture.

17. The method of providing generally uniform illumination according to claim 16, wherein installing the adjustable-length, elongate light fixture in the remainder portion occurs between the first and second fixed-length, elongate light fixtures.

* * * * *